US006603944B2

(12) United States Patent
Tatsumi

(10) Patent No.: US 6,603,944 B2
(45) Date of Patent: Aug. 5, 2003

(54) DEVELOPING APPARATUS

(75) Inventor: Hiroshi Tatsumi, Shiki-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/820,668

(22) Filed: Mar. 30, 2001

(65) Prior Publication Data

US 2001/0026715 A1 Oct. 4, 2001

(30) Foreign Application Priority Data

Mar. 30, 2000 (JP) ..... P2000-093696

(51) Int. Cl.[7] ..... G03G 15/08
(52) U.S. Cl. ..... 399/284
(58) Field of Search ..... 399/264, 265, 399/274, 279, 284

(56) References Cited

U.S. PATENT DOCUMENTS

| | | | | | |
|---|---|---|---|---|---|
| 4,760,422 | A | * | 7/1988 | Seimiya et al. | 399/284 |
| 4,866,480 | A | * | 9/1989 | Hosoya et al. | 399/284 X |
| 5,338,895 | A | * | 8/1994 | Ikegawa et al. | 399/284 X |
| 5,373,353 | A | | 12/1994 | Fukasawa | |
| 5,587,551 | A | * | 12/1996 | Ikegawa et al. | 399/284 |
| 5,752,146 | A | * | 5/1998 | Sato | 399/284 |
| 5,819,145 | A | * | 10/1998 | Tanaka et al. | 399/274 |
| 6,026,266 | A | | 2/2000 | Sakai et al. | |
| 6,032,003 | A | | 2/2000 | Tatsumi et al. | |
| 6,058,284 | A | * | 5/2000 | Okano et al. | 399/284 |
| 6,064,463 | A | | 5/2000 | Yamada et al. | |
| 6,097,918 | A | | 8/2000 | Inoue et al. | |
| 6,212,348 | B1 | | 4/2001 | Inoue et al. | |

FOREIGN PATENT DOCUMENTS

| | | | |
|---|---|---|---|
| JP | 5224521 | | 9/1993 |
| JP | 5323778 | | 12/1993 |
| JP | 764391 | | 3/1995 |
| JP | 7239611 | | 9/1995 |
| JP | 9138566 | | 5/1997 |
| JP | 11167278 | | 6/1999 |
| JP | 11-344857 | A * | 12/1999 |

* cited by examiner

*Primary Examiner*—Sandra Brase
(74) *Attorney, Agent, or Firm*—Birch, Stewart, Kolasch & Birch, LLP

(57) ABSTRACT

A developing apparatus designed to allow toner uniformly charged with a predetermined electric charge to be formed into a toner layer formed on a circumferential surface of a developing roller, and further to allow a good image to remain formed. In order to allow a proper amount of toner having a proper specific electric charge to deposit on the circumferential surface of the developing roller, the blade is bent at a bending angle of at least 45° while being positioned against the circumferential surface of the developing roller when displacement amount ΔL is at most plus 0.4 mm.

28 Claims, 7 Drawing Sheets

6
31a
31b
Sg

GREATER
ABUTTING FORCE
SMALLER
Sa
Sb

θ1
BENDING ANGLE θ
θ2

GREATER
LAYER THICKNESS
SMALLER

DEVELOPING APPARATUS

BACKGROUND OF THE INVENTION

1. Field of the Invention

The present invention relates to a developing apparatus used in an image-forming apparatus such as a copier or printer for forming an electrophotographic image, for supplying non-magnetic single component toner to a photoreceptor surface via a developing roller that has a toner layer formed on a circumferential surface thereof by means of pressing force of a blade against the developing roller.

2. Description of the Related Art

In an image-forming apparatus in which an electrostatic latent image formed on a photoreceptor surface by photoconductive action is rendered visible as a toner image, and then the toner image is transferred to a record medium, is used a developing apparatus for supplying toner to the electrostatic latent image formed on the photoreceptor surface. The developing apparatus has a developing roller rotatably disposed, which usually has part of a circumferential surface opposed to the photoreceptor surface. Toner accommodated in the developing apparatus is applied to the circumferential surface of the developing roller, which toner is then conveyed to the photoreceptor surface therefrom. In particular, a developing apparatus of a type designed to supply non-magnetic single component toner to the photoreceptor surface includes a planar plate-like blade that abuts against the circumferential surface of the developing roller to regulate the thickness of a toner layer to be formed on the circumferential surface of the developing roller, by an abutting force of the blade.

In such a developing apparatus used for image formation, using the non-magnetic single component toner, the condition of supply of the toner to the photoreceptor surface is varied, depending upon how the toner layer is formed on the circumferential surface of the developing roller. The condition of formation of the toner layer is varied, depending upon the condition of abutment of the blade against the circumferential surface of the developing roller. Accordingly, the condition of abutment of the blade against the circumferential surface of the developing roller exerts an influence upon the condition of image-formation.

A prior art developing apparatus related to blades is disclosed in, for example, Japanese Unexamined Patent Publication JP-A 5-323778 (1993), which developing apparatus has a blade having a distal end bent at an angle of 0 to 90° in a direction in which the blade is spaced apart from the circumferential surface of a developing roller so that the bend of the blade abuts against the circumferential surface of the developing roller to regulate the thickness of the toner layer thereon.

Another type of blade disclosed in Japanese Unexamined Patent Publication JP-A 7-64391 (1995) is bent at a portion or adjacent thereto where a distal end of the blade contacts the circumferential surface of the developing roller. The blade is bent at an obtuse angle (within a range between 0 and 90° in a direction in which the blade is spaced apart from the circumferential surface of the developing roller), thereby permitting a toner layer having a uniform thickness to be formed on the circumferential surface of the developing roller.

In a further type of blade disclosed in Japanese Unexamined Patent Publication JP-A 7-239611 (1995), slanted portions of a blade edge at both ends in the width direction of the blade is made smaller in length than another slanted portion of the blade edge at a central portion in the width direction of the blade, thereby increasing a force that permits the blade to regulate the thickness of a toner layer at the both ends of the blade in order to prevent excess toner from passing through between the circumferential surface of the developing roller and the blade. This structure allows the toner layer having a uniform thickness to be formed on the circumferential surface of the roller along the entire length of the blade.

In a yet further type of blade disclosed in Japanese Unexamined Patent Publication JP-A 9-138566 (1997), one curvature radius of the blade at both ends thereof where the blade is positioned against the developing roller is greater than another curvature radius of the blade at a central portion thereof, thereby preventing the occurrence of a toner layer having an irregular thickness, which otherwise would occur as a result of interference of sealing pressure. The sealing pressure is applied to the blade by means of sealing members that are disposed at both ends of the blade.

The developing apparatus using the non-magnetic single component toner must include a blade that serves a dual purpose, i.e., the function of allowing the toner supplied to the circumferential surface of the developing roller to be uniformly charged with a predetermined electric charge as well as the function of permitting the toner layer having a uniform thickness to be formed on the circumferential surface of the developing roller. However, prior art developing apparatus is impossible to serve the former function, although fulfilling the latter function. Consequently, a problem with such conventional developing apparatus is that good image formation is impossible to be always retained.

SUMMARY OF THE INVENTION

In view of the above, an object of the invention is to provide a developing apparatus capable of forming a uniformly charged toner layer having a uniform thickness all over an image formation area of a circumferential surface of a developing roller, to maintain good image forming conditions for uniform image density.

In order to achieve the object, the invention is structured as follows.

The invention provides a developing apparatus comprising:

a developing roller for supplying non-magnetic single component toner deposited in a layered fashion on a circumferential surface of the developing roller to a surface of a photoreceptor by rotation of the developing roller at a predetermined speed; and a planar plate-like blade cantilevered at one end thereof, for regulating thickness of a toner layer by pressing a part of the other end of the blade against the circumferential surface of the developing roller, the other end of the blade being bent at a bending angle in a direction in which the other end of the blade is spaced apart from the circumferential surface of the developing roller, the bending angle being 45° or more, a bend of the other end of the blade being positioned downstream by an amount of 0.4 mm from a tangent point between the blade and the developing roller with respect to a direction of rotation of the circumferential surface of the developing roller.

In this structure of the developing apparatus according to the invention, the bending angle of the blade, which influences the thickness of the toner layer on the circumferential surface of the developing roller, and the position of the bend of the blade, which influences the specific electric charge of the toner as well as the thickness of the toner layer, are set within a range in which a toner layer having a proper thickness and toner having a proper specific charge are provided. As a result, the toner layer having such a proper thickness is formed on the circumferential surface of the roller, while the toner exhibits such a proper specific charge. Consequently, properly charged toner is supplied in a proper amount to the photoreceptor surface.

According to the invention, the bending angle of the blade, which influences the thickness of the toner layer on the circumferential surface of the developing roller, and the position of the bend of the blade, which influences the specific electric charge of the toner as well as the thickness of the toner layer, are set within a range in which a toner layer having a proper thickness and toner having a proper specific charge are provided. As a result, the toner layer having an optimum thickness is formed on the circumferential surface of the roller, while the toner exhibits an optimum specific charge. Consequently, since desirably charged toner can be supplied in a proper amount to the photoreceptor surface, good image forming conditions can be maintained.

In the invention it is preferable that the bending angle of the other end of the blade is within a range of 75° to 90°.

In this structure of the developing apparatus according to the invention, the bending angle of the other end of the blade, which influences the thickness of the toner layer, is set within a range in which the thickness of the toner layer is made more proper. As a result, the toner layer having such a more proper thickness is provided on the circumferential surface of the roller, and a more proper amount of toner is thereby supplied to the photoreceptor surface.

According to the invention, the bending angle of the other end of the blade, which influences the thickness of the toner layer, is set within a range in which the thickness of the toner layer is made more proper. As a result, the toner layer having a more proper thickness can be provided on the circumferential surface of the developing roller, and a more proper amount of toner can be supplied to the photoreceptor surface.

In the invention it is preferable that the bend of the other end of the blade is positioned downstream by an amount of 0.0 to 1.0 mm from a tangent point between the blade and the developing roller with respect to a direction of rotation of the circumferential surface of the developing roller.

In this structure of the developing apparatus according to the invention, the position of the bend of the blade, which influences the thickness of the toner layer on the circumferential surface of the developing roller as well as the specific electric charge of the toner, is set within a range in which a toner layer having a more proper thickness and toner having a more proper specific charge are provided. As a result, the toner layer having such a more proper thickness is formed on the circumferential surface of the roller, while the toner provides such a more proper specific charge. Consequently, more properly charged toner is supplied in a more proper amount to the photoreceptor surface.

According to the invention, the position of the bend of the blade, which influences the thickness of the toner layer on the circumferential surface of the developing roller as well as the specific electric charge of the toner, is set within a range in which a toner layer having a more proper thickness and toner having a more proper specific charge are provided. As a result, the toner layer having such a more proper thickness is formed on the circumferential surface of the roller, while the toner provides such a more proper specific charge. Consequently, more optimum charged toner can be supplied in a more proper amount to the photoreceptor surface.

In the invention it is preferable that the developing apparatus further comprises sealing members disposed at both ends of the blade in an axial direction of the developing roller, and the other end of the blade is bent in a direction in which the other end of the blade is spaced apart from the circumferential surface of the developing roller such that bending angles of the other end of the blade at both axial ends of the developing roller are different from that at an axial intermediate portion of the developing roller.

In this structure of the developing apparatus according to the invention, bending angles of the ends of the blade which abut against both axial ends of the developing roller are different from the bending angle of the intermediate portion of the blade which abuts against an axial intermediate portion of the developing roller. Accordingly, the bending angles of the blade in the axial direction of the developing roller are set according to an influence of the sealing members on the thickness of the toner layer at the axial ends of the developing roller. As a result, a toner layer having a uniform thickness is formed over the entire area of the developing roller in the axial direction thereof.

According to the invention, bending angles of the ends of the blade which abut against both axial ends of the developing roller provided with the sealing members are different from the bending angle of the intermediated portion of the blade which abuts against an axial intermediate portion of the developing roller. Accordingly, the bending angles of the blade in the axial direction of the developing roller are set according to an influence of the sealing members on the thickness of the toner layer at the axial ends of the developing roller. As a result, a toner layer having a uniform thickness can be formed over the entire area of the developing roller in the axial direction thereof.

In the invention it is preferable that the other end of the blade is bent in a direction in which the other end of the blade is spaced apart from the circumferential surface of the developing roller such that the bending angle of the other end of the blade is varied to be gradually smaller from the axial intermediate portion toward both the axial ends of the developing roller than a predetermined bending angle of the other end of the blade at the axial intermediate portion of the developing roller.

In this structure of the developing apparatus according to the invention, the other end of the blade is bent such that the bending angle is made gradually smaller toward both the axial ends of the developing roller than a predetermined bending angle of the other end of the blade at the axial intermediate portion of the developing roller. Accordingly, an abutting force of the blade against the circumferential surface of the developing roller gradually reduced from the axial intermediate portion of the developing roller to both the axial ends of the developing roller. Then, the abutting force of the blade against the circumferential surface of the roller is equalized over a wide range of the developing roller in the axial direction thereof while abutting forces of the sealing members are exercised on both axial ends of the developing roller.

According to the invention, a bending angle of the other end of the blade is made gradually smaller toward both the axial ends of the developing roller than a predetermined bending angle of the other end of the blade at the axial intermediate portion of the developing roller. Accordingly, an abutting force of the blade against the circumferential surface of the developing roller is gradually reduced from the axial intermediate portion of the developing roller to both the axial ends of the developing roller. As a result, the abutting force of the blade against the circumferential surface of the roller can be equalized over a wide range of the developing roller in the axial direction thereof while abutting forces of the sealing members are exerted on both the axial ends of the developing roller.

In the invention it is preferable that the bending angle of the other end of the blade at both the axial ends of the developing roller is 45° or more.

In this structure of the developing apparatus according to the invention, the other end of the blade is bent such that a bending angle of the other end of the blade at both the axial ends of the developing roller gradually is gradually reduced from the predetermined bending angle of the other end of the blade at the axial intermediate portion of the developing roller to the maximum bending angle of 45°. Accordingly, an abutting force of the blade against the developing roller is gradually reduced with a decrease in bending angle of the other end of the blade at both the axial ends of the developing roller. As a result, a toner layer having a uniform thickness is formed on the circumferential surface of the developing roller over a wide range of the developing roller in the axial direction thereof while abutting forces of the sealing members are exerted on both the axial ends of the developing rollers.

According to the invention, the other end of the blade is such bent that a bending angle of the other end of the blade at both the axial ends of the developing roller gradually is gradually reduced from the predetermined bending angle of the other end of the blade at the axial intermediate portion of the developing roller to the maximum bending angle of 45°. Accordingly, an abutting force of the blade against the developing roller is gradually reduced with a decrease in bending angle of the other end of the blade at both the axial ends of the developing roller. As a result, a toner layer having a uniform thickness can be formed on the circumferential surface of the developing roller over a wide range of the developing roller in the axial direction thereof while abutting forces of the sealing members are exerted on both the axial ends of the developing rollers.

In the invention it is preferable that the bending angles of the other end of the blade at both the axial ends of the developing roller are greater than that at the axial intermediate portion of the developing roller.

In this structure of the developing apparatus according to the invention, the bending angle of the other end of the blade at both the axial ends of the developing roller is greater than the bending angle of the other end of the blade at the axial intermediate portion of the developing roller. Consequently, the abutting force of the blade against the circumferential surface of the developing roller at both the axial ends of the developing roller is greater than the abutting force of the blade against the circumferential surface of the roller at the axial intermediate portion of the developing roller. As a result, a toner layer having a smaller thickness is formed on the circumferential surface of the developing roller at both axial ends of the developing roller, while a toner layer having a greater thickness is formed thereon at the axial intermediate portion of the developing roller.

According to the invention, the bending angle of the other end of the blade at both the axial ends of the developing roller is greater than the bending angle of the other end of the blade at the axial intermediate portion of the developing roller. Consequently, the abutting force of the blade against the circumferential surface of the developing roller at both the axial ends of the developing roller is greater than another abutting force of the blade against the axial intermediate portion of the developing roller. As a result, a toner layer having a smaller thickness can be formed on the circumferential surface of the developing roller at both axial ends of the developing roller, while a toner layer having a greater thickness is formed thereon at the axial intermediate portion of the developing roller. Consequently, the toner can operatively be blocked from leaving that particular position.

In the invention it is preferable that the bending angles of the other end of the blade at both the axial ends of the developing roller is nearly 90°.

In this structure of the developing apparatus according to the invention, the other end of the blade is bent at an angle of some 90° at both the axial ends of the developing roller. Accordingly, a force of the sealing members to support the bend of the blade in cooperation with the developing roller does not act in a direction in which the blade is forced into contact with and away from the circumferential surface of the roller. As a result, an abutting force of the blade against the circumferential surface of the developing roller is invariable regardless of the presence of the sealing members.

According to the invention, the other end of the blade is bent at an angle of approximately 90° at both the axial ends of the developing roller. Accordingly, it is possible to prevent a force that supports the bend of the blade between the sealing members and the developing roller from acting in a direction in which the blade is forced into contact with and away from the circumferential surface of the developing roller. As a result, an abutting force of the blade against the circumferential surface of the developing roller is invariable regardless of the presence of the sealing members. Consequently, the abutting force of the blade on the developing roller can readily be adjusted.

In the invention the other end of the blade may preferably be formed with a cutout between either end of the developing roller and the axial intermediate portion of the developing roller.

In this structure of the developing apparatus according to the invention, the bending angle of the other end of the blade at both the axial ends of the developing roller can dramatically be made different from another bending angle of the other end of the blade at the axial intermediate portion of the developing roller.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
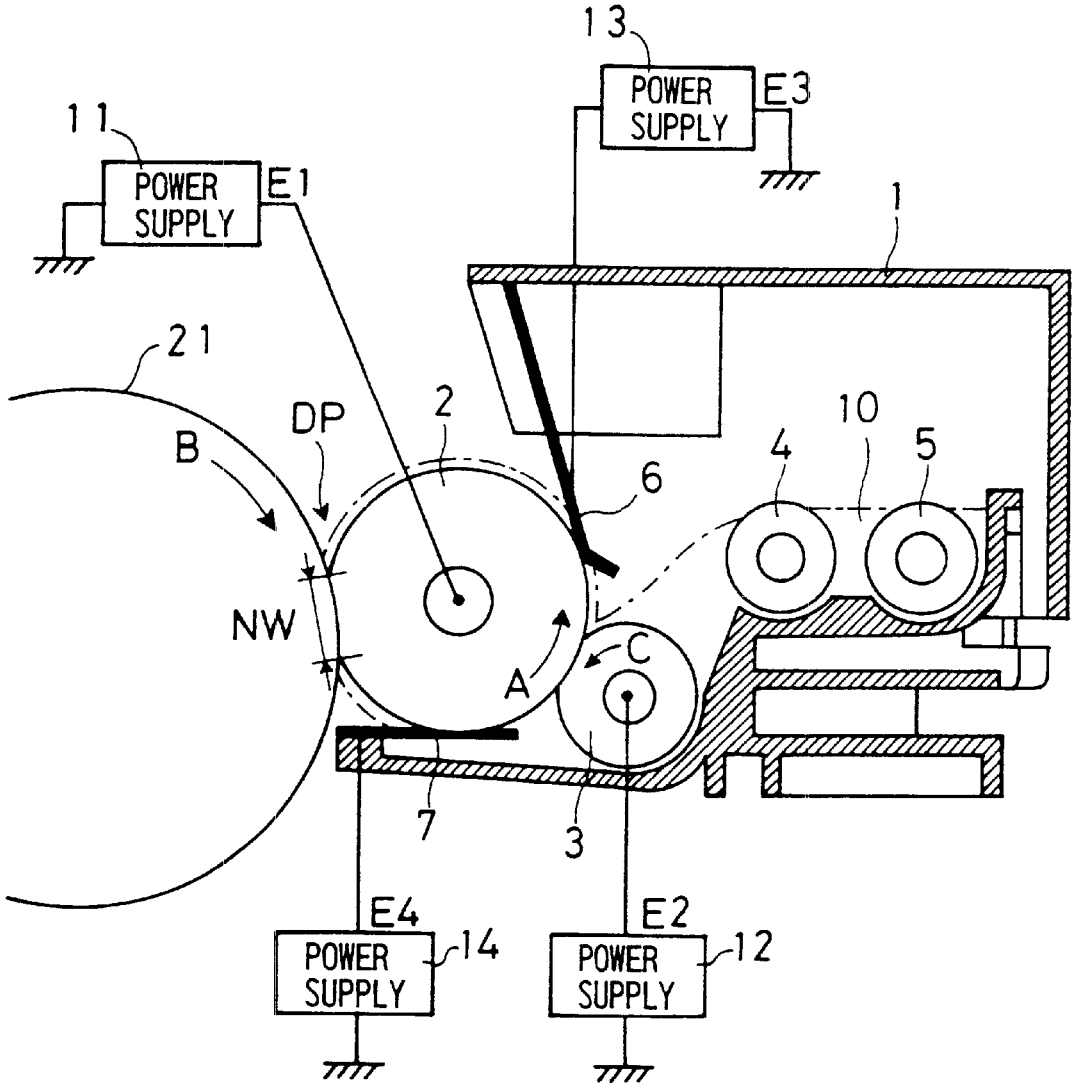
FIG. 1 is a cross-sectional view, illustrating a structure of a developing apparatus according to an embodiment of the invention.

Now referring to the drawings, preferred embodiments of the invention are described below.

FIG. 1 is a cross-sectional view, illustrating a structure of a developing apparatus according to one embodiment of the invention. A developing apparatus 1 includes a developing roller 2, a transport roller 3, agitating rollers 4 and 5, a blade 6, and a sealing member 7. The developing apparatus 1 accommodates non-magnetic single component toner (hereinafter simply called toner) 10. An image-forming apparatus has an image formation-processing section disposed therein. The image formation-processing section includes a photoreceptor drum 21. The developing roller 2 in the developing apparatus 1 is positioned so as to permit a part of a circumferential surface of the developing roller 2 to be opposed to a surface of the photoreceptor drum 21 that is disposed between an exposure process and a transfer process in the image formation-processing section. Power circuits 11–14 applies predetermined bias voltages E1–E4 to the developing roller 2, transport roller 3, blade 6, and sealing member 7, respectively.

In the developing apparatus 1, the toner 10 is agitated by the agitating rollers 4, 5, and is then supplied to the circumferential surface of the developing roller 2 via the transport roller 3 that is rotated in a direction as shown by arrow C. The developing roller 2 having the circumferential surface formed by an elastic body is rotated at a predetermined speed in a direction specified by arrow A, while being pressed against the surface of the photoreceptor drum 21 within the range of predetermined nip width NW in developing region DP. The blade 6 is pressed in the vicinity of a lower end thereof against the circumferential surface of the developing roller 2 at a predetermined pressure while the toner 10 is sandwiched between the blade 6 and the developing roller 2. The blade 6 is cantilevered at the top thereof to an inner wall of the developing apparatus 1. Such a combination of the blade 6 and developing roller 2 allows a toner layer to form with a predetermined thickness on the circumferential surface of the developing roller 2. The sealing member 7 is pressed against the circumferential surface of the developing roller 2 in order to prevent the toner 10 from flowing out of the developing apparatus 1 from below the developing roller 2.

The developing apparatus 1 as previously described allows the toner 10 to be supplied to the surface of the photoreceptor drum 21 via the circumferential surface of the developing roller 2. The photoreceptor drum 21 is irradiated with a light during the exposure process, and is then formed with an electrostatic latent image through photoconductive action. The supply of the toner 10 to the photoreceptor drum 21 causes the electrostatic latent image on the photoreceptor drum 21 to be rendered visible as a toner image. The toner image carried on the surface of the photoreceptor drum 21 which is rotated in a direction of arrow B is moved through developing region DP and transferred to a record medium surface by means of a transfer unit (not shown) during the transfer process.

In such a construction, how the electrostatic latent image on the surface of the photoreceptor drum 21 is rendered visible, i.e., how the toner image is formed thereon is influenced by both an amount of the toner to be supplied to developing region DP and electrical characteristics. The amount of the toner supplied to developing region DP and the electrical characteristics are determined by how the toner is supplied to the circumferential surface of the developing roller 2, i.e., how the toner layer is formed thereon. Such a toner layer formation is primarily determined by how the blade 6 is positioned against the circumferential surface of the developing roller 2. Therefore, formation of the toner image on the surface of the photoreceptor drum 21 depends upon how the blade 6 rests against the circumferential surface of the developing roller 2.

Figure 2:
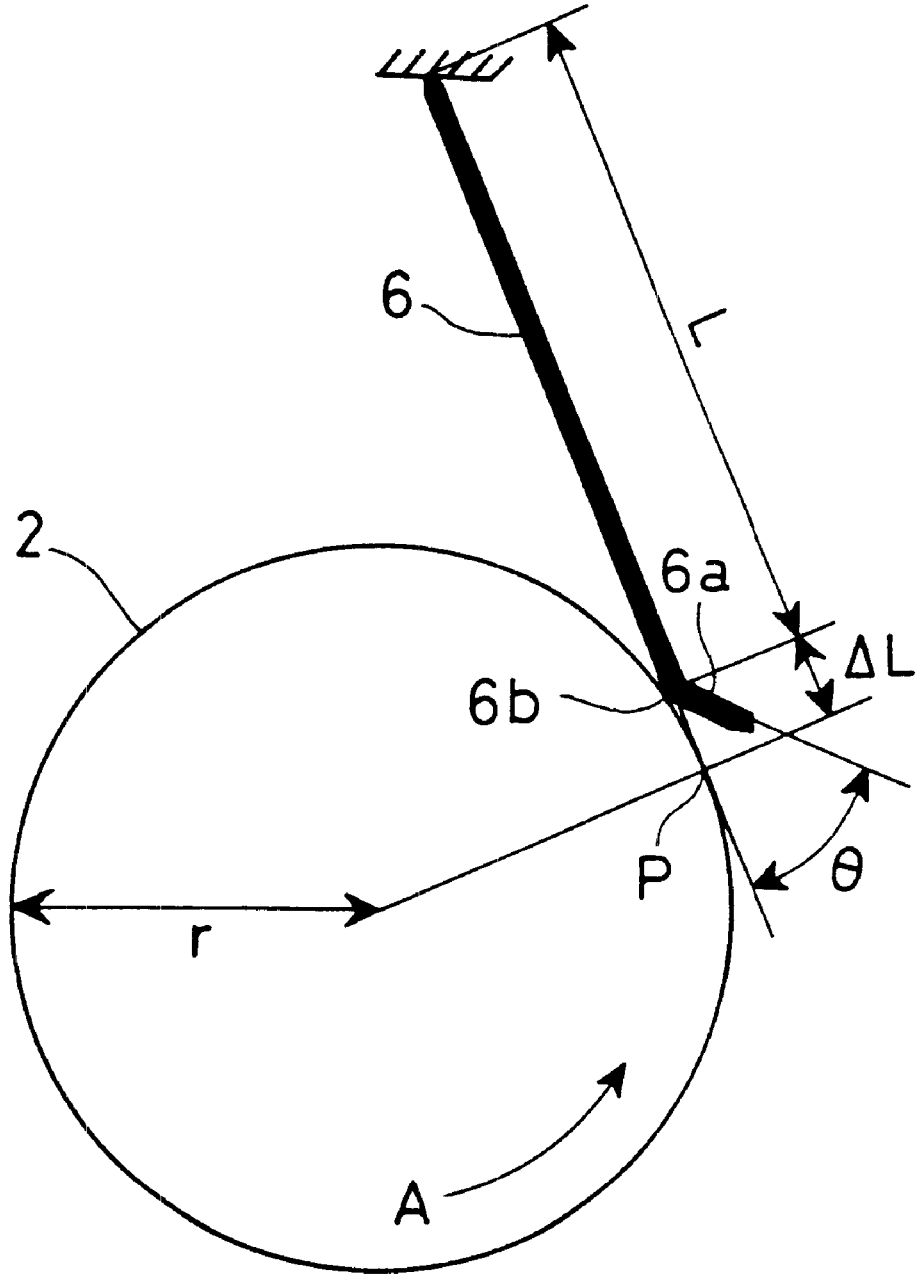
FIG. 2 is an illustration, showing a blade in abutting contact with a developing roller in the developing apparatus.

FIG. 2 illustrates the blade held in contact with the developing roller in the developing apparatus. The blade 6 is cantilevered at the top thereof. The blade 6 has a lower end 6*a* bent at a bend 6*b* at predetermined bending angle θ in a direction in which the lower end 6*a* is spaced apart from the circumferential surface of the developing roller 2. The blade 6 is positioned in contact with the circumferential surface of the developing roller 2 at the bend 6*b*. A position at which the bend 6*b* is positioned against the circumferential surface of the developing roller 2 is defined by displacement amount ΔL with respect to intersection (tangent) point P at which the normal of the developing roller 2 in a direction perpendicular to the blade 6 intersects the circumferential surface of the developing roller 2. In displacement amount ΔL, upstream and downstream sides of the developing roller 2 with respect to a rotational direction of the developing roller 2 as shown by arrow A assume to be positive and negative value zones, respectively. As previously described, the elastic body forms the circumferential surface of the developing roller 2. The bend 6*b* of the blade 6 is pressed against the circumferential surface of the roller 2 within a predetermined circumferentially extending range thereof.

Experimental results will now be described. In such experiments, the following components were used: the developing roller 2 having a diameter of 18 mm, formed by a material of an electrically conductive NBR rubber having a urethane-coated surface; the transport roller 3 formed by an electrically conductive silicon sponge roller; and, the blade 6 formed by a material of a 0.1 mm thick SUS304 having the bend 6*b* of a curvature radius of some 0.1 mm. In addition, the experiments were conducted under the following conditions: the developing roller 2 was rotated at a rotational speed of 225 mm/sec.; the blade 6 was held in contact with the circumferential surface of the developing roller 2 at a pressure ranging from 17.5 to 20 gf/cm; and, the difference in bias voltage between the developing roller 2 and the blade 6 is minus 110 V.

Figure 3:
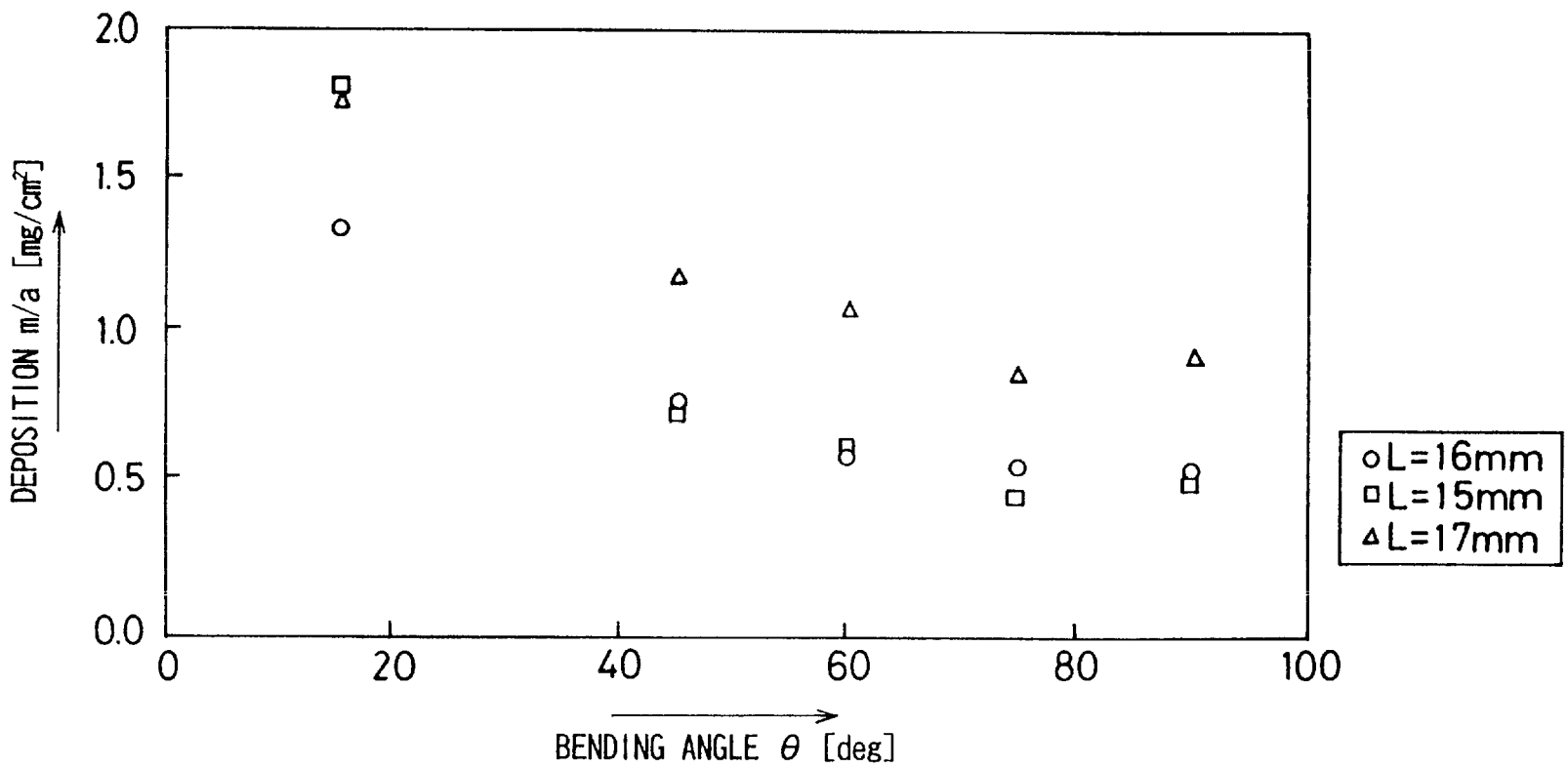
FIG. 3 is a graph, illustrating a relationship between bending angles of the blade and amounts of toner supplied to a circumferential surface of the developing roller in the developing apparatus.

FIG. 3 is a graph, illustrating a relationship between bending angles of the blade and amounts of the toner supplied to the circumferential surface of the developing roller in the developing apparatus. In FIG. 3, L denotes an effective length of the blade 6 between the top of the blade 6 and the bend 6*b*. As illustrated in FIG. 3, all three different blades 6 having respective effective lengths L of 15 mm, 16 mm, and 17 mm permit substantially uniformed amounts of the toner to be applied to the circumferential surface of the developing roller 2 regardless of bending angle θ when bending angle θ ranges from 75° to 90°.

Figure 4:
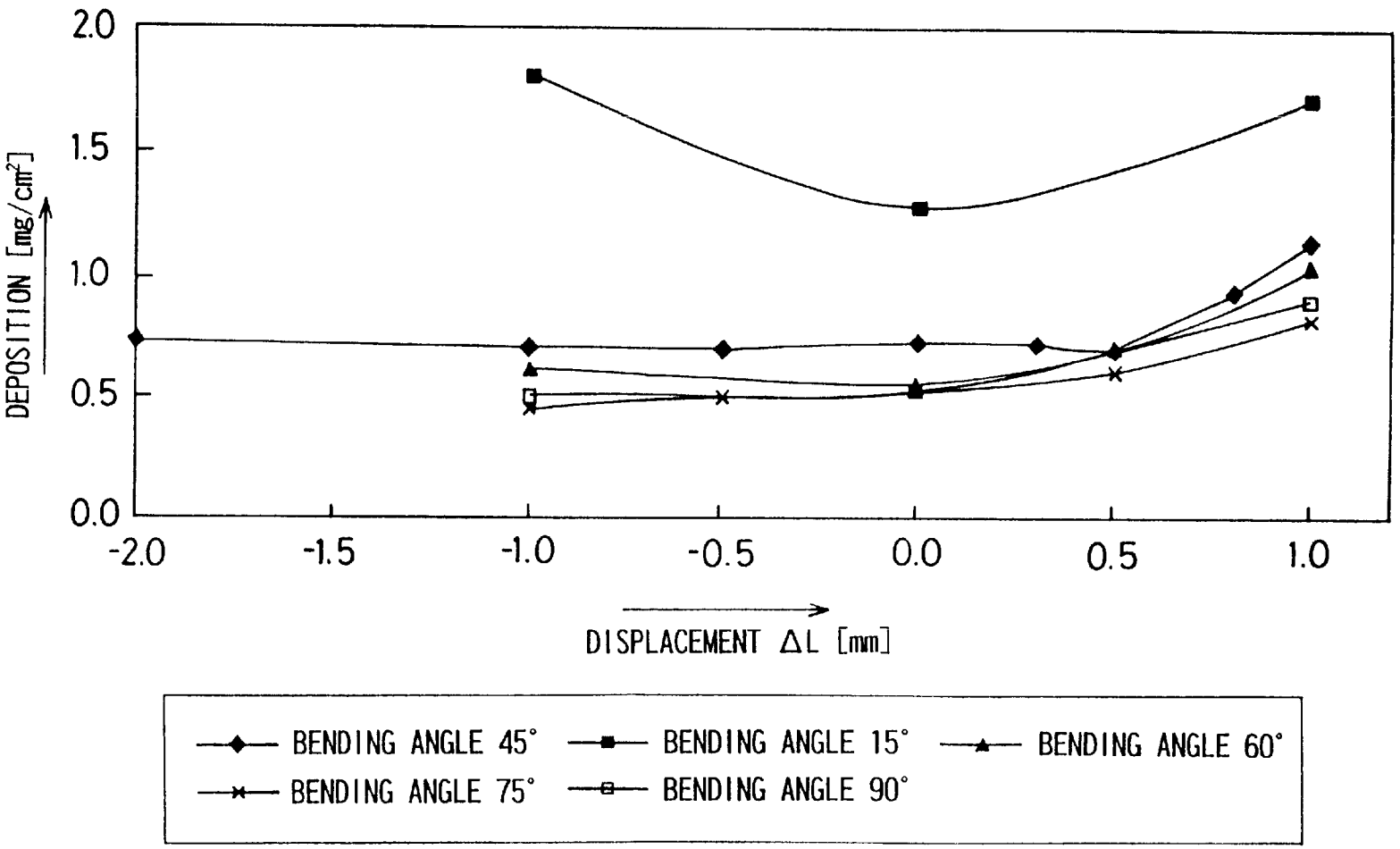
FIG. 4 is a graph, illustrating a relationship between a displacement amount when the blade is positioned against the circumferential surface of the developing roller and an amount of the toner supplied to the circumferential surface of the developing roller in the developing apparatus.

FIG. 4 is a graph, illustrating a relationship between a displacement amount when the blade is positioned against the circumferential surface of the developing roller and an amount of the toner supplied to the circumferential surface of the developing roller in the developing apparatus. As illustrated in FIG. 4, the blade 6 bent at respective bending angles θ except for 15° permits substantially uniformed amounts of the toner to be supplied to the circumferential surface of the developing roller 2 regardless of displacement amount ΔL when displacement amount ΔL falls within the range between plus 0.4 mm and minus 1.0 mm. In particular, when bending angle θ is 45°, an amount of the toner supplied to the circumferential surface of the developing roller 2 was observed to remain uniform over a wide area thereof.

Figure 5:
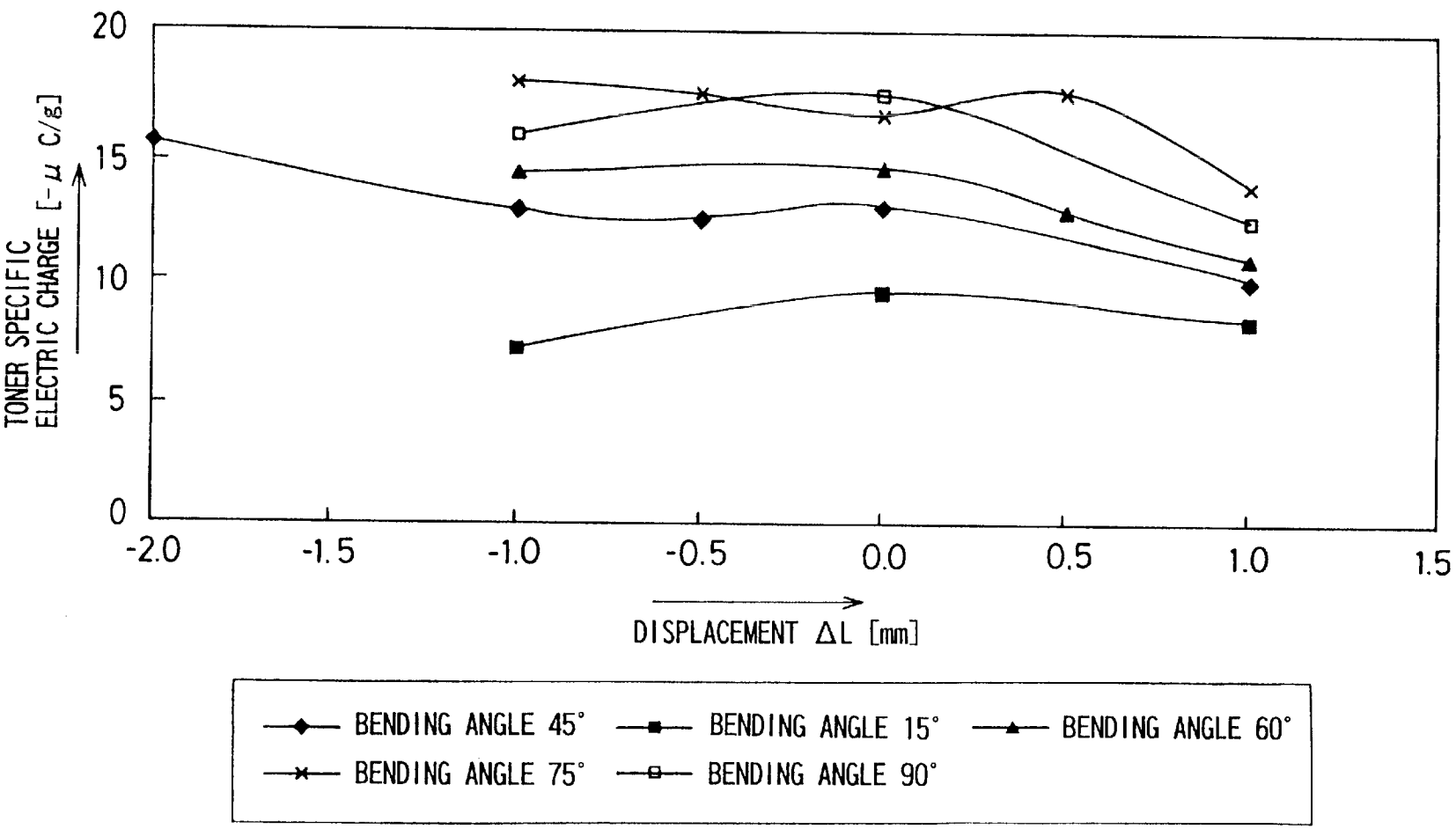
FIG. 5 is a graph, illustrating a relationship between a displacement amount when the blade is positioned in contact with the circumferential surface of the developing roller and a specific electric charge of the toner supplied to the circumferential surface of the developing roller in the developing apparatus.

FIG. 5 is a graph, illustrating a relationship between a displacement amount when the blade is positioned in contact with the circumferential surface of the developing roller and a specific electric charge of the toner supplied to the circumferential surface of the developing roller in the developing apparatus. As illustrated in FIG. 5, the blade 6 bent at any one of the bending angles θ of 15°, 45°, 60°, 75°, and 90° allows the toner having substantially constant levels of specific electric charges to be applied to the circumferential surface of the developing roller 2 regardless of displacement amount ΔL when displacement amount ΔL ranges between plus 0.4 mm and minus 1.0 mm.

From the results shown in FIGS. 3–5, in order to supply a proper amount of toner having a proper specific charge to the circumferential surface of the developing roller 2, the blade 6 positioned against the circumferential surface of the developing roller 2 must be bent at bending angle θ of 45° or greater while adjusting displacement amount ΔL to plus 0.4 mm or smaller.

From the result shown in FIG. 3, it is more preferable to bent the blade 6 at bending angle θ that ranges from 75° to 90°, thereby a more stable amount of toner can be supplied to the circumferential surface of the roller 2.

From the results shown in FIGS. 4 and 5, the blade 6 is still more preferably positioned in contact with the circumferential surface of the developing roller 2 when displacement amount ΔL ranges from 0.0 to minus 1.0 mm. As a result, an even more stable amount of toner is supplied to the circumferential surface of the roller 2 while having an even more stable specific charge.

Next, effects caused by the presence of sealing members 31*a*, 31*b* will be described. The sealing members 31*a*, 31*b* are disposed at both ends of the blade 6 in an axial direction of the developing roller 2. While the blade 6 is positioned against the circumferential surface of the developing roller 2, the sealing members 31*a*, 31*b* are opposed to an inner surface (or the reverse side of a surface opposed to the roller 2) of the blade 6. The sealing members 31*a*, 31*b* prevent the toner 10 from flowing out from a gap between the circumferential surface of the roller 2 and the blade 6 at both axial ends of the developing roller 2.

Figures 6A, 6B, 6C, 6D:
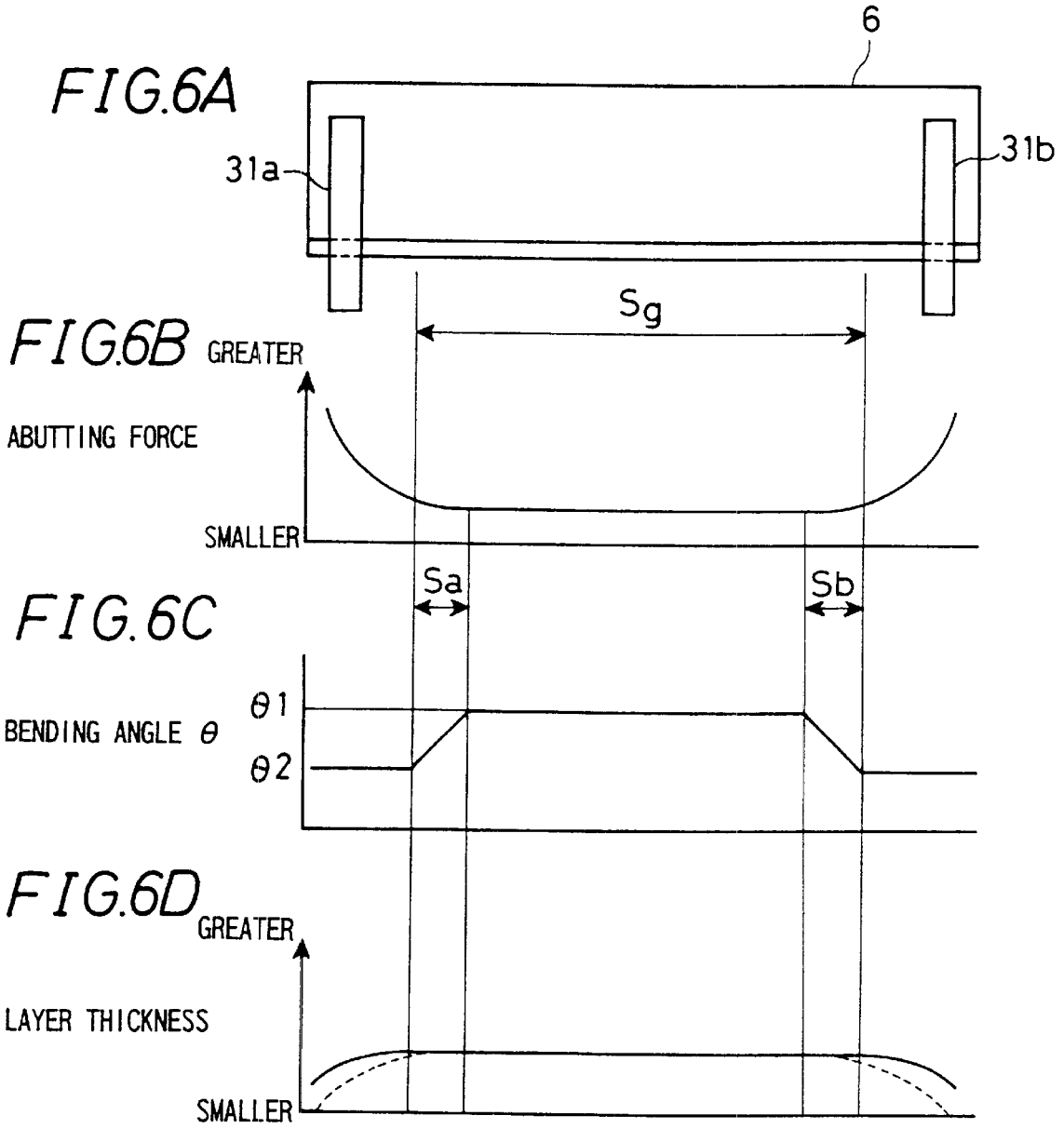
FIGS. 6A through 6D are views, showing a structure of an essential portion in a developing apparatus according to another embodiment, abutting forces of a blade against a developing roller, bending angles of the blade, and amounts of toner supplied to the developing roller.

FIGS. 6A–6D illustrate a structure of an essential portion in a developing apparatus according to another embodiment of the invention, abutting forces of the blade against the developing roller, bending angles of the blade, and amounts of the toner supplied to the developing roller. As illustrated in FIG. 6A, in the developing apparatus, the sealing member 31*a*, 31*b* are disposed in the vicinity of both ends of the blade 6 in a longitudinal direction thereof (which is the axial direction of the developing roller 2) so as to cover both ends of the blade 6 in the longitudinal direction thereof from the backside of the blade 6. Accordingly, the blade 6 is positioned between the sealing member 31*a*, 31*b* and the developing roller 2 at a position in the vicinity of both ends of the blade 6 in the longitudinal direction thereof, and is pressed against the developing roller 2 at that particular position by means of the sealing members 31*a*, 31*b*.

As a result, as illustrated in FIG. 6B, the blade 6 is held in abutting contact with the circumferential surface of the roller 2 by abutting forces that are stronger in the vicinity of both ends of the blade 6 in the longitudinal direction thereof than at an axial intermediate portion of the blade 6. Consequently, an amount of the toner supplied to the circumferential surface of the roller 2 is reduced in the vicinity of both axial ends of the roller 2. In this respect, when an image-forming area Sg includes the area in which the abutting force is increased, the sealing members 31*a*, 31*b* give degrading effects to developing.

As illustrated in FIG. 6C, bending angle θ of the blade 6 at a position where the blade 6 is positioned against the circumferential surface of the developing roller 2 is made gradually smaller in specific ranges Sa, Sb in the vicinity of both ends of the blade 6 in the longitudinal direction thereof. As a result, as evidenced by the results as illustrated in FIG. 3, an amount of the toner supplied to both axial ends of the developing roller 2 increases from the level shown by a broken line in FIG. 6D to the level shown by a solid line in FIG. 6D. As a result, effects caused by the sealing members 31*a*, 31*b* being pressed against the blade 6 are alleviated, thereby allowing a uniform amount of the toner to be applied to the roller 2 at image-forming region Sg.

Figure 7A:
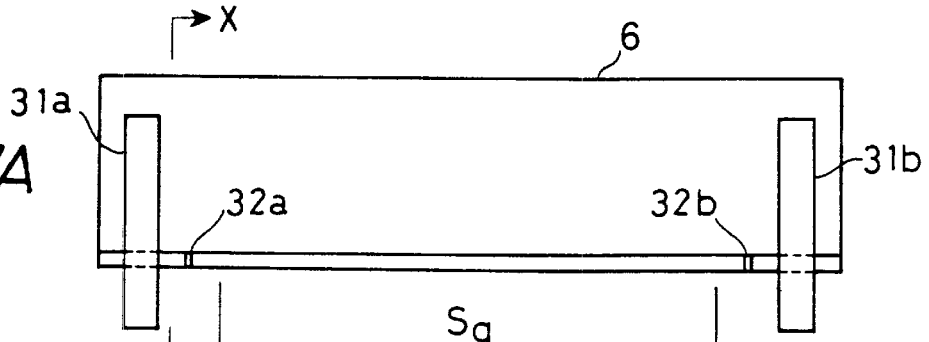
FIGS. 7A through 7D are views, showing a structure of an essential portion in a developing apparatus according to a further embodiment, abutting forces of a blade against a developing roller, bending angles of the blade and amounts of toner supplied to the roller.
Figure 7B:
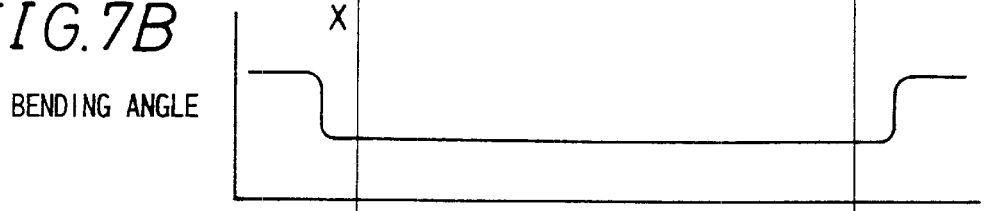

FIGS. 7A–7D illustrate a structure of an essential portion in a developing apparatus according to a further embodiment of the invention, bending angles of the blade, and abutting forces of the blade against the developing roller. As illustrated in FIGS. 7A, 7B, in the developing apparatus, bending angle θ of the blade 6 in the vicinity of both ends thereof in the longitudinal direction thereof, at which the sealing members 31*a*, 31*b* are positioned against the blade 6, are dramatically increased when compared with bending angle θ of the blade 6 at an axial intermediate portion thereof in the longitudinal direction thereof.

Figure 7C:
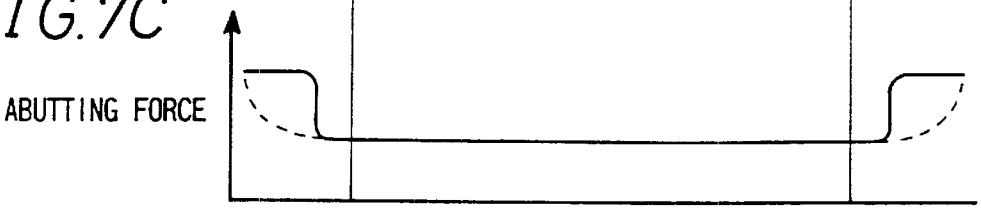

As evidenced by the results in FIG. 3, when the blade 6 is held in contact with the circumferential surface of the roller 2 at increased bending angle θ, then the abutting force of the blade 6 against the circumferential surface of the roller 2 is increased in the vicinity of both axial ends of the roller 2, as illustrated in FIG. 7C. As a result, the toner supply is decreased on the developing roller 2 in the vicinity of both the axial ends of the roller 2, and the toner flow can effectively be prevented at that particular position.

Further, the blade 6 is provided with cutouts 32*a*, 32*b* so as to be bent at different bending angle θ through the cutouts 32*a*, 32*b*. This structure isolates bending angles of the blade 6 at both axial ends of the roller 2 from a different bending angle of the blade 6 at the axial intermediate portion of the roller 2. As a result, the toner can reliably be prevented from flowing out from both the ends of the roller 2, while the toner supply remains satisfactorily to the axial intermediate portion of the roller 2. The cutouts 32*a*, 32*b* formed outside of image-forming region Sg allow a proper amount of the toner to be supplied to the circumferential surface of the roller 2 at image-forming region Sg.

Figure 7D:
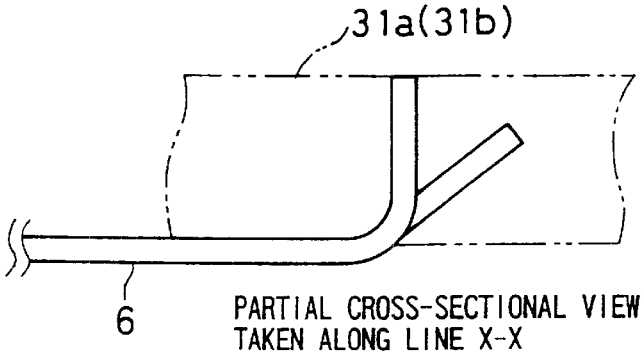

Further, as shown in FIG. 7D, the blade 6 bent at an angle of approximately 90° at both axial ends of the roller 2. As a result, a force of the sealing members 31*a*, 31*b* to support the bend of the blade 6 to the developing roller 2 does not act in a direction in which the blade 6 is urged against and away from the circumferential surface of the roller 2. As a result, the abutting force of the blade 6 against the developing roller 2 can readily be adjusted.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing apparatus comprising:

a developing roller for supplying non-magnetic single component toner deposited in a layered fashion on a circumferential surface of the developing roller to a surface of a photoreceptor by rotation of the developing roller at a predetermined speed; and a planar plate-like blade cantilevered at one end thereof, for regulating thickness of a toner layer by pressing a part of the other end of the blade against the circumferential surface of the developing roller, the other end of the blade being bent at a bending angle in a direction in which the other end of the blade is spaced apart from the circumferential surface of the developing roller, the bending angle being 45° or more, a bend of the other end of the blade being positioned downstream from a position which exists upstream by an amount between 0.0 to 1.0 mm from a tangent point, which is an intersection point at which the normal of the developing roller in a direction perpendicular to the blade intersects the circumferential surface of the developing roller, between the blade and the developing roller with respect to a direction of rotation of the circumferential surface of the developing roller.

2. The developing apparatus of claim 1, wherein the bending angle of the other end of the blade is within a range of 75° to 90°.

3. The developing apparatus of claim 1, wherein the bend of the other end of the blade is positioned downstream from a position which exists upstream by an amount of 0.4 mm from a tangent point between the blade and the developing roller with respect to a direction of rotation of the circumferential surface of the developing roller.

4. The developing apparatus of claim 3, further comprising:

sealing members disposed at both ends of the blade in an axial direction of the developing roller, wherein the other end of the blade is bent in a direction in which the other end of the blade is spaced apart from the circumferential surface of the developing roller such that bending angles of the other end of the blade at both axial ends of the developing roller are different from that at an axial intermediate portion of the developing roller.

5. The developing apparatus of claim 4, wherein the other end of the blade is bent in a direction in which the other end of the blade is spaced apart from the circumferential surface of the developing roller such that the bending angle of the other end of the blade is varied to be gradually smaller from the axial intermediate portion toward both the axial ends of the developing roller than a predetermined bending angle of the other end of the blade at the axial intermediate portion of the developing roller.

6. The developing apparatus of claim 5, wherein the bending angle of the other end of the blade at both the axial ends of the developing roller is 45° or more.

7. The developing apparatus of claim 4, wherein the bending angles of the other end of the blade at both the axial ends of the developing roller are greater than that at the axial intermediate portion of the developing roller.

8. The developing apparatus of claim 7, wherein the bending angles of the other end of the blade at both the axial ends of the developing roller is nearly 90°.

9. The developing apparatus of claim 3, further comprising:

sealing members disposed at both ends of the blade in an axial direction of the developing roller, wherein the other end of the blade is bent in a direction in which the other end of the blade is spaced apart from the circumferential surface of the developing roller such that bending angles of the other end of the blade at both axial ends of the developing roller are different from that at an axial intermediate portion of the developing roller.

10. The developing apparatus of claim 9, wherein the other end of the blade is bent in a direction in which the other end of the blade is spaced apart from the circumferential surface of the developing roller such that the bending angle of the other end of the blade is varied to be gradually smaller from the axial intermediate portion toward both the axial ends of the developing roller than a predetermined bending angle of the other end of the blade at the axial intermediate portion of the developing roller.

11. The developing apparatus of claim 10, wherein the bending angle of the other end of the blade at both the axial ends of the developing roller is 45° or more.

12. The developing apparatus of claim 9, wherein the bending angles of the other end of the blade at both the axial ends of the developing roller are greater than that at the axial intermediate portion of the developing roller.

13. The developing apparatus of claim 12, wherein the bending angles of the other end of the blade at both the axial ends of the developing roller is nearly 90°.

14. The developing apparatus of claim 3, further comprising:

sealing members disposed at both ends of the blade in an axial direction of the developing roller, wherein the other end of the blade is bent in a direction in which the other end of the blade is spaced apart from the circumferential surface of the developing roller such that bending angles of the other end of the blade at both axial ends of the developing roller are different from that at an axial intermediate portion of the developing roller.

15. The developing apparatus of claim 14, wherein the other end of the blade is bent in a direction in which the other end of the blade is spaced apart from the circumferential surface of the developing roller such that the bending angle of the other end of the blade is varied to be gradually smaller from the axial intermediate portion toward both the axial ends of the developing roller than a predetermined bending angle of the other end of the blade at the axial intermediate portion of the developing roller.

16. The developing apparatus of claim 15, wherein the bending angle of the other end of the blade at both the axial ends of the developing roller is 45° or more.

17. The developing apparatus of claim 14, wherein the bending angles of the other end of the blade at both the axial ends of the developing roller are greater than that at the axial intermediate portion of the developing roller.

18. The developing apparatus of claim 17, wherein the bending angles of the other end of the blade at both the axial ends of the developing roller is nearly 90°.

19. The developing apparatus of claim 1, further comprising:

sealing members disposed at both ends of the blade in an axial direction of the developing roller, wherein the other end of the blade is bent in a direction in which the other end of the blade is spaced apart from the circumferential surface of the developing roller such that bending angles of the other end of the blade at both axial ends of the developing roller are different from that at an axial intermediate portion of the developing roller.

20. The developing apparatus of claim 19, wherein the other end of the blade is bent in a direction in which the other end of the blade is spaced apart from the circumferential surface of the developing roller such that the bending angle of the other end of the blade is varied to be gradually smaller from the axial intermediate portion toward both the axial ends of the developing roller than a predetermined bending angle of the other end of the blade at the axial intermediate portion of the developing roller.

21. The developing apparatus of claim 20, wherein the bending angle of the other end of the blade at both the axial ends of the developing roller is 45° or more.

22. The developing apparatus of claim 19, wherein the bending angles of the other end of the blade at both the axial ends of the developing roller are greater than that at the axial intermediate portion of the developing roller.

23. The developing apparatus of claim 22, wherein the bending angles of the other end of the blade at both the axial ends of the developing roller is nearly 90°.

24. A developing apparatus comprising:

a developing roller for supplying non-magnetic single component toner deposited in a layered fashion on a circumferential surface of the developing roller to a surface of a photoreceptor by rotation of the developing roller at a predetermined speed; and a planar plate-like blade cantilevered at one end thereof, for regulating thickness of a toner layer by pressing a part of the other end of the blade against the circumferential surface of the developing roller, the other end of the blade being bent at a bending angle in a direction in which the other end of the blade is spaced apart from the circumferential surface of the developing roller, the bending angle being 45° or more, a bend of the other end of the blade being positioned downstream by an amount of 0.0 to 1.0 mm from a tangent point, which is an intersection point at which the normal of the developing roller in a direction perpendicular to the blade intersects the circumferential surface of the developing roller, between the blade and the developing roller with respect to a direction of rotation of the circumferential surface of the developing roller.

25. The developing apparatus of claim 24, wherein the bend of the other end of the blade is positioned downstream by an amount of 0.4 mm from a tangent point between the blade and the developing roller with respect to a direction of rotation of the circumferential surface of the developing roller.

26. A developing apparatus comprising:

a developing roller for supplying non-magnetic single component toner deposited in a layered fashion on a circumferential surface of the developing roller to a surface of a photoreceptor by rotation of the developing roller at a predetermined speed; and a planar plate-like blade cantilevered at one end thereof, for regulating thickness of a toner layer by pressing a part of the other end of the blade against the circumferential surface of the developing roller, the other end of the blade being bent at a bending angle in a direction in which the other end of the blade is spaced apart from the circumferential surface of the developing roller, the bending angle being 45° or more, a bend of the other end of the blade being positioned downstream from a position which exists upstream by an amount of 0.4 mm from a tangent point, which is an intersection point at which the normal of the developing roller in a direction perpendicular to the blade intersects the circumferential surface of the developing roller, between the blade and the developing roller with respect to a direction of rotation of the circumferential surface of the developing roller.

27. A developing apparatus comprising:

a developing roller for supplying non-magnetic single component toner deposited in a layered fashion on a circumferential surface of the developing roller to a surface of a photoreceptor by rotation of the developing roller at a predetermined speed; and a planar plate-like blade cantilevered at one end thereof, for regulating thickness of a toner layer by pressing a part of the other end of the blade against the circumferential surface of the developing roller, the other end of the blade being bent at a bending angle in a direction in which the other end of the blade is spaced apart from the circumferential surface of the developing roller, the bending angle being 45° or more, a bend of the other end of the blade being positioned downstream from a position which exists upstream by an amount of 0.5 to 1.0 mm from a tangent point, which is an intersection point at which the normal of the developing roller in a direction perpendicular to the blade intersects the circumferential surface of the developing roller, between the blade and the developing roller with respect to a direction of rotation of the circumferential surface of the developing roller.

28. A developing apparatus comprising:

a developing roller for supplying non-magnetic single component toner deposited in a layered fashion on a circumferential surface of the developing roller to a surface of a photoreceptor by rotation of the developing roller at a predetermined speed; and a planar plate-like blade cantilevered at one end thereof, for regulating thickness of a toner layer by pressing a part of the other end of the blade against the circumferential surface of the developing roller, the other end of the blade being bent at a bending angle in a direction in which the other end of the blade is spaced apart from the circumferential surface of the developing roller, the bending angle being 45° or more, a bend of the other end of the blade being positioned downstream from a position which exists upstream by an amount of 0.8 to 1.0 mm from a tangent point, which is an intersection point at which the normal of the developing roller in a direction perpendicular to the blade intersects the circumferential surface of the developing roller, between the blade and the developing roller with respect to a direction of rotation of the circumferential surface of the developing roller.

* * * * *